US006869113B2

(12) United States Patent
Burt

(10) Patent No.: US 6,869,113 B2
(45) Date of Patent: Mar. 22, 2005

(54) SECURITY SEAL

(75) Inventor: David Austin Burt, Berkshire (GB)

(73) Assignee: ITW Limited, Swansea (GB)

( * ) Notice: Subject to any disclaimer, the term of this patent is extended or adjusted under 35 U.S.C. 154(b) by 0 days.

(21) Appl. No.: 10/396,723

(22) Filed: Mar. 26, 2003

(65) Prior Publication Data

US 2004/0012211 A1 Jan. 22, 2004

(30) Foreign Application Priority Data

Mar. 27, 2002 (EP) ..... 02252263

(51) Int. Cl.[7] ..... B65D 27/30
(52) U.S. Cl. ..... 292/307 R; 292/307 A
(58) Field of Search ..... 292/307 R, 315, 292/318, 319, 323, 324, 325, 307 A

(56) References Cited

U.S. PATENT DOCUMENTS 674,526 A * 5/1901 Tyden ..... 292/324
1,553,188 A * 9/1925 Hamilton ..... 292/318
2,140,320 A * 12/1938 Keidel ..... 292/318
4,690,444 A * 9/1987 Arthur ..... 292/324
4,929,006 A * 5/1990 Tsay ..... 292/324
5,018,286 A * 5/1991 Zahner ..... 40/665
5,524,945 A * 6/1996 Georgopoulos et al. 292/307 A
6,343,819 B1 * 2/2002 Shiozaki ..... 292/307 R
6,494,508 B1 * 12/2002 Dreisbach et al. ..... 292/307 R
6,557,898 B2 * 5/2003 Kissinger et al. ..... 283/70

* cited by examiner

*Primary Examiner*—Gary Estremsky
(74) *Attorney, Agent, or Firm*—Lowe Hauptman Gilman & Berner, LLP

(57) ABSTRACT

Security seals (1) are used to indicate that a closed container has remained closed throughout a journey or during transport to show that its contents have not been tampered with. Once fixed such seals can only be removed by destroying them. A padlock-type security seal (1) includes a recess (10) in its body (2) accessible from the front face which houses a locking collet (11). The collet (11), in use, locks the leading end (4) of the hasp (3) of the seal (1) into the body (2). A cap (12) is welded onto the body (2) to close the recess (10) and seal the collet (11) into the body (2). Preferably, the body (2) of the padlock-type seal is chosen to be a color which will give a good contrast with a barcode (14) applied to it. The color of the cap (12) can vary from that of the body (2) to enable an audit trail of the seals (1).

17 Claims, 2 Drawing Sheets

SECURITY SEAL

BACKGROUND OF THE INVENTION

Security seals are used to indicate that a closed container has remained closed throughout a journey or during transport to show that its contents have not been tampered with. Once fixed, such seals can only be removed by destroying them. They usually include a unique reference number to enable it to be ensured that the seal has not been removed and replaced.

Such security seals are often colour-coded to facilitate an audit trail. For example, trolleys containing alcoholic drinks loaded onto airlines include a seal of one colour when first delivered to the aircraft to indicate that they are full and have not been tampered with. Such seals are only removed once the aircraft is airborne. Before landing the trolleys now only part full and possibly including part empty bottles are once again sealed to prevent their contents being tampered with, but, this time with a seal of different colour to show that the trolley has been used.

A popular type of seal is the so-called "padlock seal" which is shaped like a padlock and so is easily recognisable as a lock or seal. Another advantage of this type of seal is that it includes a significant surface area to carry the unique reference number and any logo. Nowadays it is often required that the unique reference number is present in the form of a machine readable barcode. To enable such barcodes to be read easily there must be sufficient contrast between the marking applied to the seal and the background colour of the seal and this is not easy to achieve when the seals themselves are colour-coded.

SUMMARY OF THE INVENTION

According to this invention a padlock-type security seal includes a recess in its body accessible from the front face which houses a locking collet, the collet, in use, locking the leading end of the hasp of the seal into the body, and a cap welded onto the body to close the recess and seal the collet into the body.

Preferably, the body of the padlock-type seal is chosen to be a colour which will give a good contrast with the barcode. Thus, preferably the body of the padlock-type seal is formed of white or light coloured material and the barcode elements coloured black or a dark colour. This enables the barcode to be prepared readily by a laser engraving operation and ensures that there is always a good contrast available between the elements of the barcode and the body colour of the seal when reading the barcode. The colour of the cap can vary, again to enable an audit trail of the seals. Where the body of the seal is white or a light colour, typical colours of the cap are white, black, red, orange, purple, yellow, blue or green.

With the arrangements in accordance with this invention the entire assembly and marking of the seal are all carried out from its front face which facilitates its manufacture.

Preferably the "hinge" end of the hasp is connected to a tear-off strip which extends perpendicular to and around the lower portion of the body of the padlock-type seal.

Preferably the tear-off portion terminates in a free tab to enable it to be grasped by the user to remove the seal.

Since the body and collet of all seals produced are common, the only component that needs to be varied specially to "colour-code" the seal is the cap. Thus with a relatively small inventory it is possible to produce a wide variety of seals.

BRIEF DESCRIPTION OF THE DRAWINGS

A particular example of a security seal in accordance with this invention will now be described with reference to the accompanying drawings in which.

DESCRIPTION OF PARTICULAR EMBODIMENT

Figure 1:
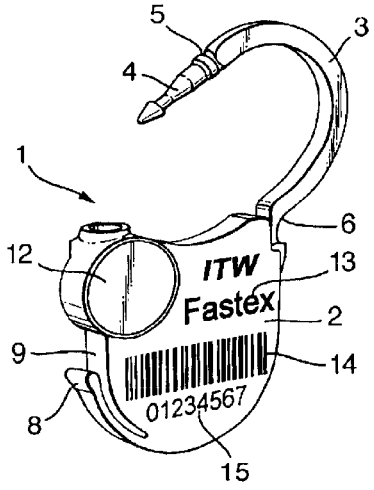
FIG. 1 is a perspective view of the seal.
Figure 2:
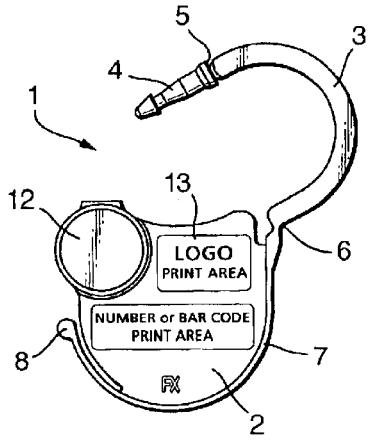
FIG. 2 is a front elevation of the seal in the open configuration.
Figure 3:
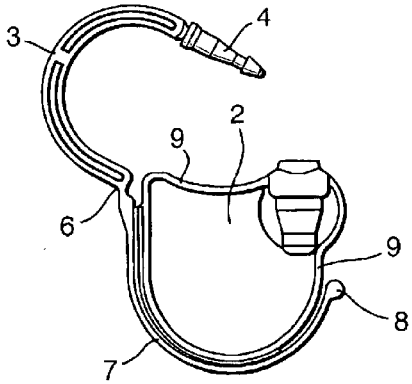
FIG. 3 is a rear elevation of the seal in the open configuration.

The padlock-type security seal 1 comprises a body 2 and a hasp 3. At the free end of the hasp 3 is an arrowhead 4 which is separated from the remainder of the hasp 3 by a break-off point 5. The break-off point fails so destroying the seal when excessive force is applied to the hasp 3 in an attempt to re-open the seal. The break-off point 5 is arranged to fail before the arrowhead 4 breaks. The other end of the hasp 3 is joined via a hinge portion 6 to a tear-off tab 7 which forms a side wall portion of the body 2. The tear-off tab 7 terminates in a free tab 8 which can be gripped by the user to tear off the tear-off tab 7 to enable the seal to be removed after use. Other side wall portions 9 give the body 2 of the seal the appearance of thickness and solidity.

Figure 4:
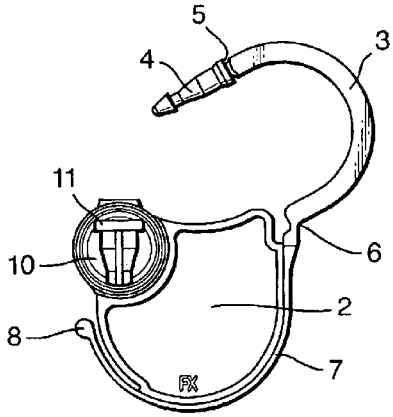
FIG. 4 is a front elevation of the seal, partly assembled.
Figure 5:
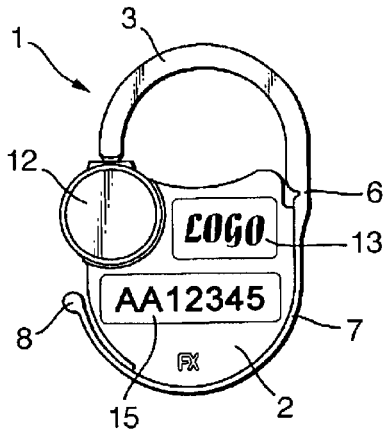
FIG. 5 is a front elevation of the seal closed.

The body portion 2 of the seal includes a front opening recess 10 (shown best in FIG. 4) which houses a bifurcated collet 11. The bifurcated collet 11 cooperates with the arrowhead 4 to lock the hasp 3 into the body 2 of the padlock when the seal is closed. The collet 11 and recess 10 are closed by a cap 12 which is ultrasonically welded to the body 2.

Typically the body and cap are both formed from polypropylene whereas the bifurcated collet 11 is formed from acetal. The body 2 and hasp 3 portion of the seal are formed of white or slightly off white polypropylene material whereas the cap 12 is typically formed from a contrasting colour to enable the seals to be colour-coded. The body 2 is printed or, laser engraved, for example with a logo 13, and a unique serial number in the form of a barcode 14 and/or a printed number 15.

An advantage of the present seal is in the high visibility of the barcode 14, serial number 15 and logo 13 on the large front face of the body portion 2 of the seal. By making the body portion light in colour the markings can be made in dark colour so that there is good contrast between the background colour and the markings applied to the seal. Also, the entire assembly and printing operations can be carried out from the front face of the seal so facilitating its manufacture. Further, the cap 12 can be provided in a variety of colours such as white, black, red, orange, purple, yellow, blue and green to provide colour-coded seals to facilitate an audit trail.

Figure 6:
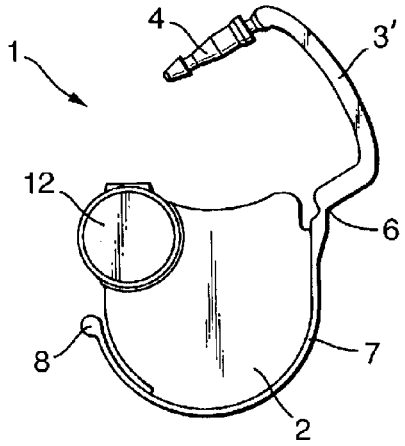
FIG. 6 is a front elevation of a modification of the seal in an open configuration; and, FIG. 7 is a front elevation of the modification of the seal closed.
Figure 7:
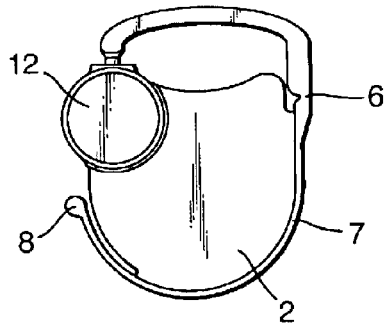

A modification of the padlock-type seal is shown in FIGS. 6 and 7. In this modification the hasp 3 is of a lower height, but, apart from this the seals are identical.

What I claim is:

1. A security seal, comprising:

a body having a front face carrying indicia;

a hasp joined onto said body;

a recess in said body, said recess having an opening on said front face of said body;

a locking element mounted in said recess in said body, said locking element, in use, locking an end of said hasp into said body; and a cap attached to said body to close said opening of said recess and retain said locking element in said body;

wherein said body further includes a rear face opposite to the front face and a side face connecting said front and rear faces; and said recess further includes a second opening on said side face of said body, said second opening being configured to allow said end of said hasp to pass through into said recess in use.

2. The seal of claim 1, wherein said body of said seal carries a barcode as said indicia, and said body is chosen to be a color which gives a good contrast with said barcode.

3. The seal of claim 2, wherein said body of said seal is formed of one of white and light colored material, elements of said barcode arc colored one of black and a dark color.

4. The seal of claim 3, wherein said barcode is prepared by a laser engraving operation.

5. A padlock-type security seal, comprising:

a body having a front face;

a hasp joined onto said body;

a recess in said body opening to said front face of said body;

a locking collet mounted in said recess in said body, said locking collet, in use, locking an end of said hasp into said body; and a cap welded onto said body to close said recess and seal said collet into said body;

wherein the color of said cap is different from the color of said body.

6. The seal of claim 5, wherein said body of the seal is white and said cap is one of black, red, orange, purple, yellow, blue and green.

7. The seal of claim 1, wherein said body includes a tear-off strip which extends around a portion of said body of said seal and wherein said hasp is joined to said body via said tear-off strip.

8. The seal of claim 7, wherein said tear-off strip terminates in a free tab which is, in use, to be grasped by the user to remove said seal.

9. The seal of claim 5, wherein said body includes a tear-off strip which extends around a portion of said body of said seal and wherein said hasp is joined to said body via said tear-off strip.

10. The seal of claim 9, wherein said tear-off strip terminates in a free tab which is, in use, to be grasped by the user to remove said seal.

11. The seal of claim 6, wherein said body includes a tear-off strip which extends around a portion of said body of said seal and wherein said hasp is joined to said body via said tear-off strip.

12. The seal of claim 11, wherein said tear-off strip terminates in a free tab which is, in use, to be grasped by the user to remove said seal.

13. The seal of claim 5, further comprising on said front face of said body indicia unique for said seal.

14. The seal of claim 1, wherein said cap and said body are made of different materials.

15. The seal of claim 1, wherein said cap is visually recognizable when said front face is seen in plan view.

16. The seal of claim 1, wherein said cap is configured to be indicative of a status of said seal.

17. A security seal, comprising:

a body having a front face;

a hasp joined onto said body;

a recess in said body, said recess having an opening on said front face of said body;

a locking element in said recess for locking, in use, an end of said hasp into said body; and a cap closing said opening of said recess;

wherein the color of said cap is different from the color of said front face of said body; and said end of said hasp is insertable into said recess through another opening which is oriented in a direction substantially perpendicular to the opening being closed by said cap.

* * * * *